US008674788B2

(12) United States Patent
Le

(10) Patent No.: US 8,674,788 B2
(45) Date of Patent: Mar. 18, 2014

(54) PHASE SHIFTER HAVING AN ACCELEROMETER DISPOSED ON A MOVABLE CIRCUIT BOARD

(75) Inventor: Quoc M. Le, Plano, TX (US)

(73) Assignee: Andrew LLC, Hickory, NC (US)

( * ) Notice: Subject to any disclaimer, the term of this patent is extended or adjusted under 35 U.S.C. 154(b) by 891 days.

(21) Appl. No.: 12/751,646

(22) Filed: Mar. 31, 2010

(65) Prior Publication Data

US 2011/0241954 A1 Oct. 6, 2011

(51) Int. Cl.
*H01P 1/18* (2006.01)

(52) U.S. Cl.
USPC ..... 333/161; 342/375

(58) Field of Classification Search
USPC ..... 333/156, 161, 139; 342/375; 343/757, 343/820
See application file for complete search history.

(56) References Cited

U.S. PATENT DOCUMENTS

| | | | | |
|---|---|---|---|---|
| 5,917,455 | A * | 6/1999 | Huynh et al. | 343/792.5 |
| 6,573,875 | B2 | 6/2003 | Zimmerman et al. | |
| 6,603,436 | B2 | 8/2003 | Heinz et al. | |
| 6,873,931 | B1 * | 3/2005 | Nower et al. | 702/151 |
| 7,231,825 | B2 * | 6/2007 | Davidson | 73/510 |
| 2003/0076198 | A1 * | 4/2003 | Phillips et al. | 333/161 |

* cited by examiner

*Primary Examiner* — Benny Lee
(74) *Attorney, Agent, or Firm* — Husch Blackwell LLP

(57) ABSTRACT

A physical angle of a portion of a variable element, such as a phase shifter, is used to determine a desired antenna beam attribute, such as beam downtilt. In one example, a variable element includes a stationary circuit board and a rotatable circuit board. The stationary circuit board has at least one transmission line having a first output and a second output. The rotatable circuit board includes an input and a coupling section, the coupling section located to capacitively couple an input signal to the at least one transmission line between the first output and the second output, and the accelerometer being oriented such that it provides a signal indicative of a physical angle of the rotatable circuit board with respect to vertical.

11 Claims, 4 Drawing Sheets

10

PHASE SHIFTER HAVING AN ACCELEROMETER DISPOSED ON A MOVABLE CIRCUIT BOARD

FIELD OF INVENTION

The present invention relates generally to base station antennas. More particularly, the present invention relates to a rotating wiper-type phase shifter used in a variable element of a feed network.

BACKGROUND

Wireless mobile communication networks continue to evolve given the increased traffic demands on the networks, the expanded coverage areas for service and the new systems being deployed. Cellular ("wireless") communications networks rely on a network of base station antennas for connecting cellular devices, such as cellular telephones, to the wireless network. Many base station antennas include a plurality of radiating elements in a linear array. Various attributes of the antenna array, such as beam elevation angle, beam azimuth angle, and half power beam width may be adjusted by electrical-mechanical controllers. See, for example, U.S. Pat. Nos. 6,573,875 and 6,603,436, both of which are incorporated by reference. For example, with respect to U.S. Pat. No. 6,573,875, a plurality of radiating elements may be provided in an approximately vertical alignment. A feed network may be provided to supply each of the radiating elements with a signal. The phase angle of the signals provided to the radiating elements may be adjusted to cause a radiated beam angle produced by the antenna array to tilt up or down from a nominal or default beam angle.

Phase angles may be adjusted by mechanical phase shifters. In the example of the '875 patent, phase shifters are coupled by a common mechanical linkage. An expected phase angle may be ascertained from markings on a linkage rod or by a sensor in an electro-mechanical actuator located off the antenna panel extending beyond a bottom edge of the panel. However, markings on a linkage rod may not be determined remotely from the site, and known sensors in an electromechanical actuator typically comprise potentiometers. Furthermore, such potentiometers may have degraded performance as they age, and determine a position of the linkage, which for various reasons, may not necessarily be consistently correlated to a position of a phase shifter arm itself. What is needed is a more robust sensor which may be closely integrated into an electrical control circuit and which more directly measures the position of a phase shifter arm.

Also, previously known antenna arrays were known to have adjustable mounts which allowed default tilt angle to be set. In this arrangement, a mounting hardware allows the antenna array to be mechanically inclined with respect to a vertical axis to set a default phase angle (e.g., the angle at which a radiated beam would propagate if electrical tilt was set to zero). Default phase angle must be recorded during installation, and typically is, not remotely detectable.

SUMMARY OF THE INVENTION

According to an example of the present invention, a physical angle of a portion of a variable element, such as a phase shifter, is used to determine a desired antenna beam attribute, such as beam downtilt. In one example, a variable element includes a stationary circuit board and a rotatable circuit board. The stationary circuit board has at least one transmission line having a first output and a second output. The rotatable circuit board includes an input and a coupling section, the coupling section located to capacitively couple an input signal to the at least one transmission line between the first output and the second output, and the accelerometer being oriented such that it provides a signal indicative of a physical angle of the rotatable circuit board with respect to vertical.

The variable element also includes a look-up table having a plurality of physical angles of the rotatable circuit board correlated to a plurality of beam attributes and a controller configured to access the lookup table to obtain a physical angle of the rotatable circuit board that corresponds to a desired beam attribute, and to access the accelerometer to obtain the signal indicative of a physical angle of the rotatable circuit board. The look up table and the controller may be physically located on the rotatable circuit board. In alternate embodiments, the look up table and the controller may be physically located on a circuit board associated with an actuator assembly.

In one illustrated example, the stationary circuit board and the rotatable circuit board comprise a phase shifter and the beam attribute comprises a beam downtilt angle. In this example, the controller may be configured to operate an actuator to cause the rotatable circuit board to move to a physical angle corresponding to a desired beam downtilt angle. In another example, the actuator includes the controller, a non-volatile memory coupled to the controller. The look-up table, a motor coupled to the controller, and the controller are further configured to operate the motor to cause the rotatable circuit board to move to a physical angle corresponding to a desired beam attribute.

While a single axis may be used to determine the orientation of the rotatable circuit board with respect to ground in some examples (e.g., antennas mounted vertically and/or with fixed azimuth angles), another example of the present invention includes an accelerometer which provides signals indicative of an angle with respect to vertical with respect to a plurality of axes. The look-up table further comprises a plurality of default tilt angles and beam downtilt angles correlated to the physical angle with respect to vertical with respect to a plurality of axes.

In another example of the present invention, the variable element is incorporated in a feed network of a panel antenna. The panel antenna includes a plurality of radiating elements, an input, and a first feed network coupling the input to a first set of dipoles of the plurality of radiating element. The first feed network includes a plurality of transmission lines and at least a first variable element as set forth above, and an actuator coupled to the variable element. In another example, the panel antenna may excite portions of the radiating elements separately, such as when cross dipoles are exited with differently phased signals. In this example the panel antenna would further include a second feed network coupling a second input to a second set of dipoles of the plurality of radiating elements, the second feed network comprising a plurality of transmission lines and at least a second variable element, the second variable element being mechanically coupled to the first variable element. Because the first and second variable elements are mechanically coupled, and move together, a second accelerometer is not needed on the second variable element.

DETAILED DESCRIPTION OF THE INVENTION

Figure 1:
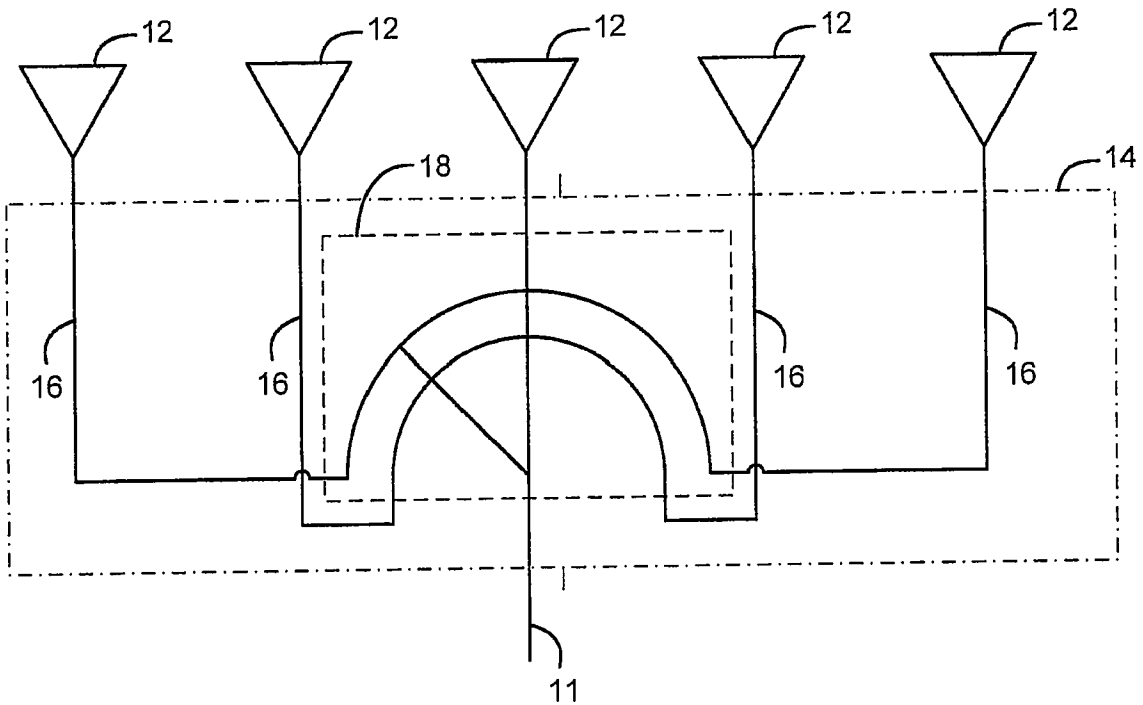
FIG. 1 comprises a schematic diagram of a panel antenna including a feed network, which may be used in combination with the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

A typical antenna array 10 may include an input 11, a plurality of radiating elements 12 and a feed network 14 coupling the input 11 to the radiating elements 12. A schematic diagram of a typical feed network 14 for an antenna array 10 is provided in FIG. 1. The feed network 14 may include a plurality of transmission lines 16 and one or more variable elements 18. The transmission lines 16 have nominal impedance which may be selected to match an impedance of an RF line that couples the antenna array 10 to a Low Noise Amplifier (not shown). Transmission lines 16 may be implemented as microstrip transmission lines, coaxial cables, or other impedance-controlled transmission media. The variable elements 18 may comprise one or more phase shifters, power dividers, a combination of the two, or another type of variable element. The variable elements 18 may comprise differential variable elements. In one example, first and second feed networks 14 are provided, with a first feed network 14 driving a first set of dipoles on radiating elements 12, and a second feed network 14 driving a second set of dipoles on radiating elements 12.

Figure 2:
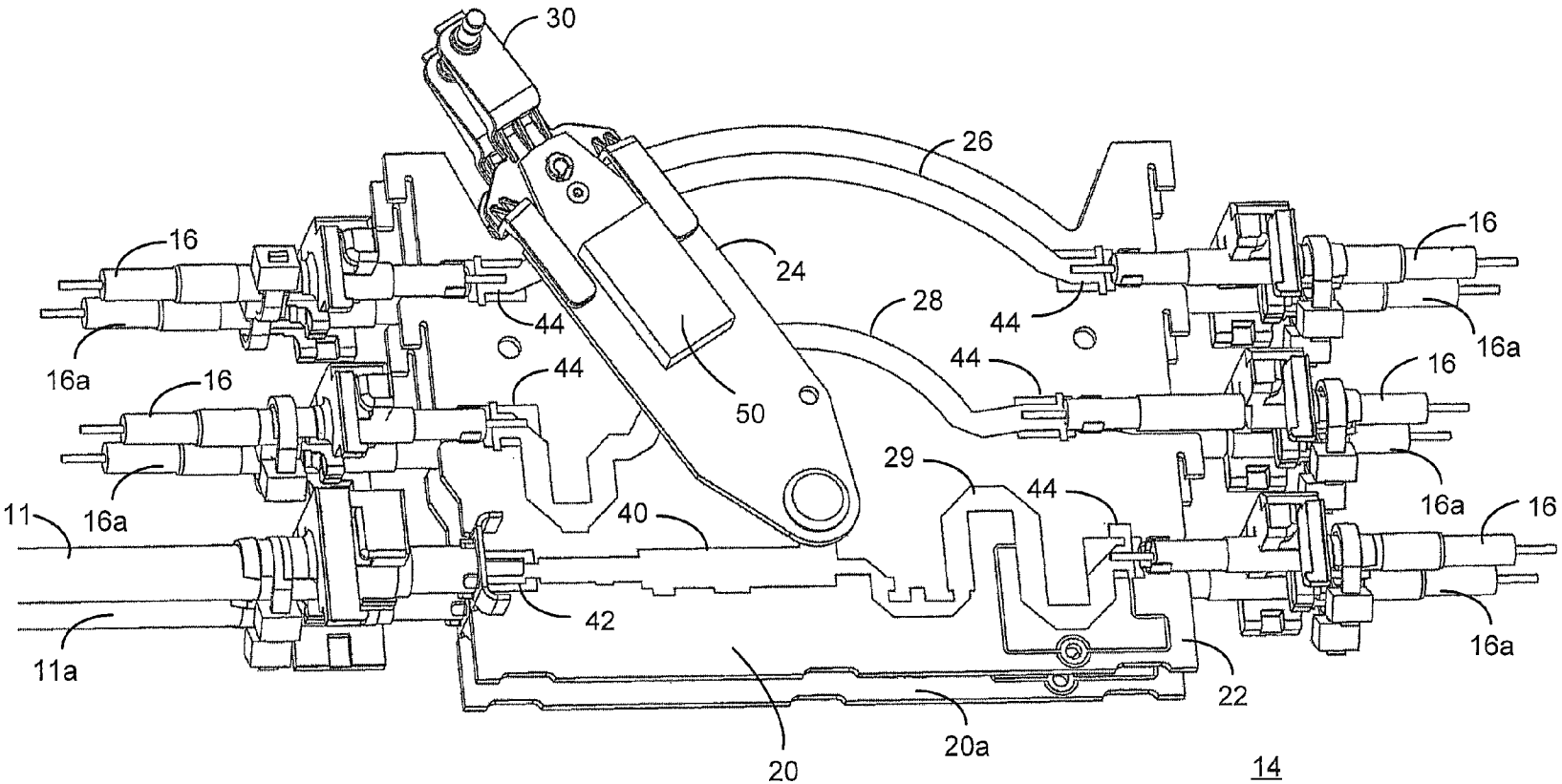
FIG. 2 illustrates one example of a variable element according to the present invention.

In one example of the invention, the variable elements 18 comprise rotating wiper-type phase shifters 20 connected to transmission lines 16 and input 11 as shown in FIG. 2. A phase shifter 20, in one example, may be implemented with first and second printed circuit boards (PCBs). In one illustrated example, as seen in FIG. 2, the first PCB may comprise a stationary PCB 22, and the second PCB may comprise a rotatable wiper PCB 24.

The stationary PCB 22 includes a plurality of transmission line traces 26, 28. The transmission line traces 26, 28 are generally arcuate. The transmission line traces 26, 28 may be disposed in a serpentine pattern to achieve a longer effective length. In an illustrated example, there are two transmission line traces 26, 28 on the stationary PCB 22, one transmission line trace 26 being disposed along an outer circumference of a PCB 22, and one transmission line trace 28 being disposed on a shorter radius concentrically within the outer transmission line trace 26. A third transmission line trace 29 connects an input on the stationary PCB 22 to an unshifted output.

In the illustrated example, the stationary PCB 22 may include one or more input traces 40 leading from an input pad 42 near an edge of the PCB 22 to where the pivot of the wiper PCB 24 is located. (The use of "input" and "output" herein refers to the radio frequency signal path as the panel antenna transmits. Radio frequency signals received by the panel antenna flow in the reverse direction.) Electrical signals on an input trace 40 are coupled to the wiper PCB 24. The wiper PCB 24 couples the electrical signals to the transmission line traces 26, 28. Transmission line traces 26, 28 may be coupled to output pads 44 to which a coaxial cable may be connected. Alternatively, the stationary PCB 22 may be coupled to stripline transmission lines on a panel without additional coaxial cabling. As the wiper PCB 24 moves, an electrical length from the wiper PCB 24 to each radiating element served by the transmission lines 26, 28 changes. For example, as the wiper PCB 24 moves to shorten the electrical length from the input transmission line trace 40 to a first radiating element, the electrical length from the input transmission line trace end to a second radiating element increases by a corresponding amount.

In one example illustrated in FIG. 2 two phase shifters 20 and 20*a* are illustrated, with phase shifter 20 stacked on top of phase shifter 20*a* as illustrated. Transmission lines 16*a* and input 11 *a* are connected to phase shifter 20*a*. Phase shifter 20 and transmission lines 16 comprise the first feed network 14 driving the first set of dipoles on radiating elements 12 (FIG. 1), and phase shifter 20 *a* and transmission lines 16*a* comprise the second feed network 14 driving the second set of dipoles on radiating elements 12 (FIG. 1). The wiper PCBs 24 are coupled by slider 30 such that the wiper PCBs 24 move in unison. In this example, only one wiper PCB 24 requires an accelerometer. A throw rod (not shown) may be coupled to a pin on slider 30 by way of a slotted component (not shown). The throw rod may be actuated by hand or by an electrical-mechanical actuator.

In one example, at least one wiper PCB 24 includes an accelerometer 50. Preferably, the accelerometer 50 comprises a multiple-axis digital accelerometer, such as Digital Accelerometer ADXL345, from Analog Devices, Inc. In this example, the accelerometer 50 is a digital 3-axis accelerometer. However, other accelerometers may be acceptable in alternate embodiments. The accelerometer 50 provides acceleration information for the three axes of rotation as serial data. In one example, the serial data conforms to the standard Inter-Integrated Circuit, or $I^2C$, digital interface. X-axis data, Y-axis data, and Z-axis data may be obtained by reading appropriate registers in the accelerometer 50.

Figure 3:
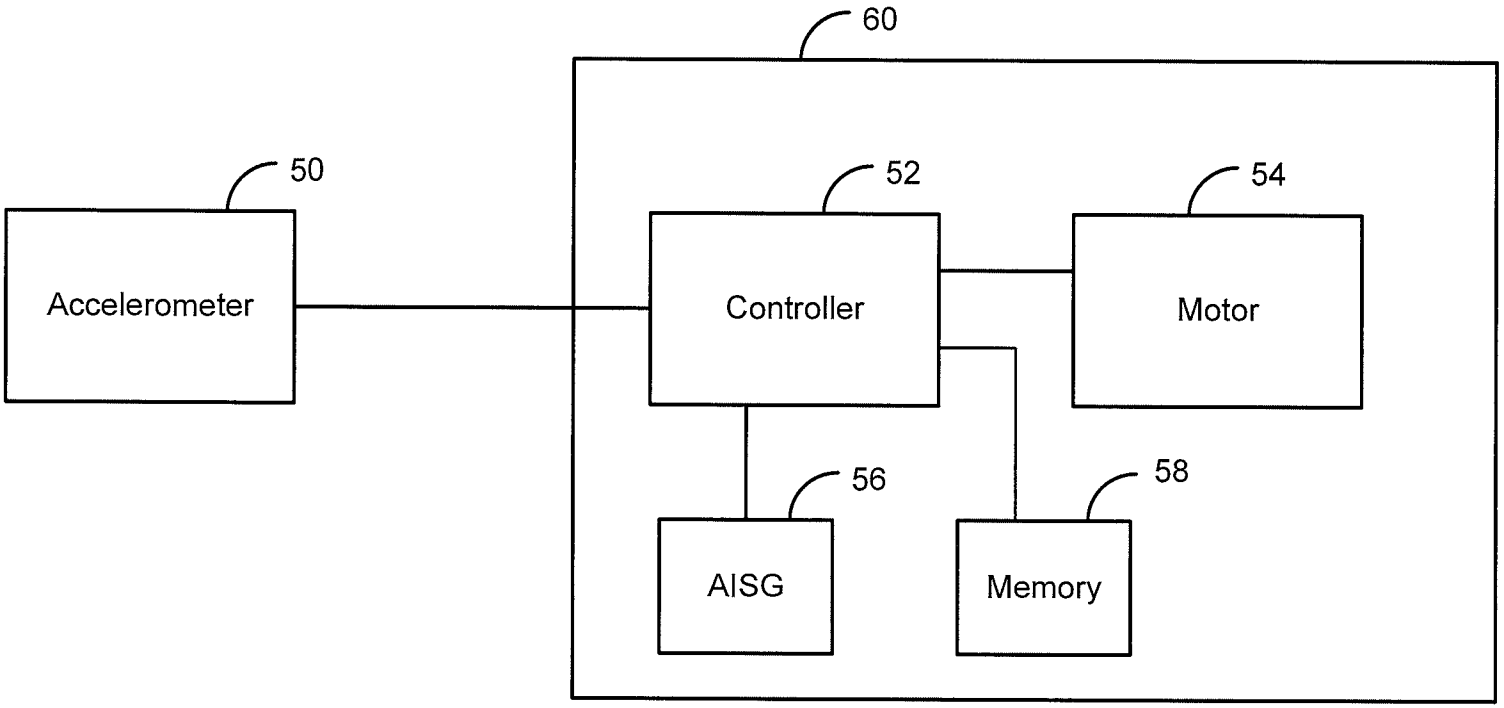
FIG. 3 comprises a block diagram according to one example of the present invention.

As seen in FIG. 3, a microcontroller 52 may interface with the accelerometer 50 and read the data registers. In one example, a microcontroller 52 is included in an actuator 60, which is mechanically coupled to the phase shifter 20. The actuator 60 includes a motor 54 and an AISG connector 56. The microcontroller 52, through operation of the motor 54, controls the location of wiper PCB 24. The microcontroller 50 receives and transmits control information through AISG connectors 56. In an alternate embodiment, the microcontroller 52 may be located on the wiper PCB 24.

The accelerometer 50 is mounted on the wiper PCB 24 as shown in FIG. 2 such that it may detect an actual angle of the wiper PCB 24 with respect to vertical. Wiper PCB 24 physical angle θ may be determined by a first axis of the accelerometer 50. If wiper PCB 24 angle with respect to vertical is the only angle to be determined, the solution may be had with a single axis of the accelerometer 50 and the following trigonometry relationship:

$$V_{OUTX}=V_{OFF}+S\times\sin\theta$$

Where $V_{OUTX}$ is the voltage output from the X-axis of the accelerometer, $V_{OFF}$ is the offset voltage and S is the sensitivity of the accelerometer. The acceleration on the X-axis due to gravity is:

$$A_X=(V_{OUTX}-V_{OFF})\div S$$

In this case, the solution for wiper arm angle is:

$$\theta=\sin^{-1}(A_X)$$

In another example, the phase shifter is mounted such that the axis of rotation of the default angle of the panel antenna is on a different axis (e.g., the Y-axis) from an axis of rotation of the wiper PCB 24. A default angle of the antenna panel may be determined by a second axis of the accelerometer 50 in the same manner as above.

In another example, three axes of the accelerometer 50 may be employed to determine the wiper PCB 24 angle and default angle. This embodiment is especially applicable when a portion of the panel antenna (e.g., the reflectors and radiating elements) is rotatable to adjust beam azimuth angle. This solution takes into account the delta angle of the azimuth from boresight to determine true mechanical tilt and wiper arm angle.

Figure 4:
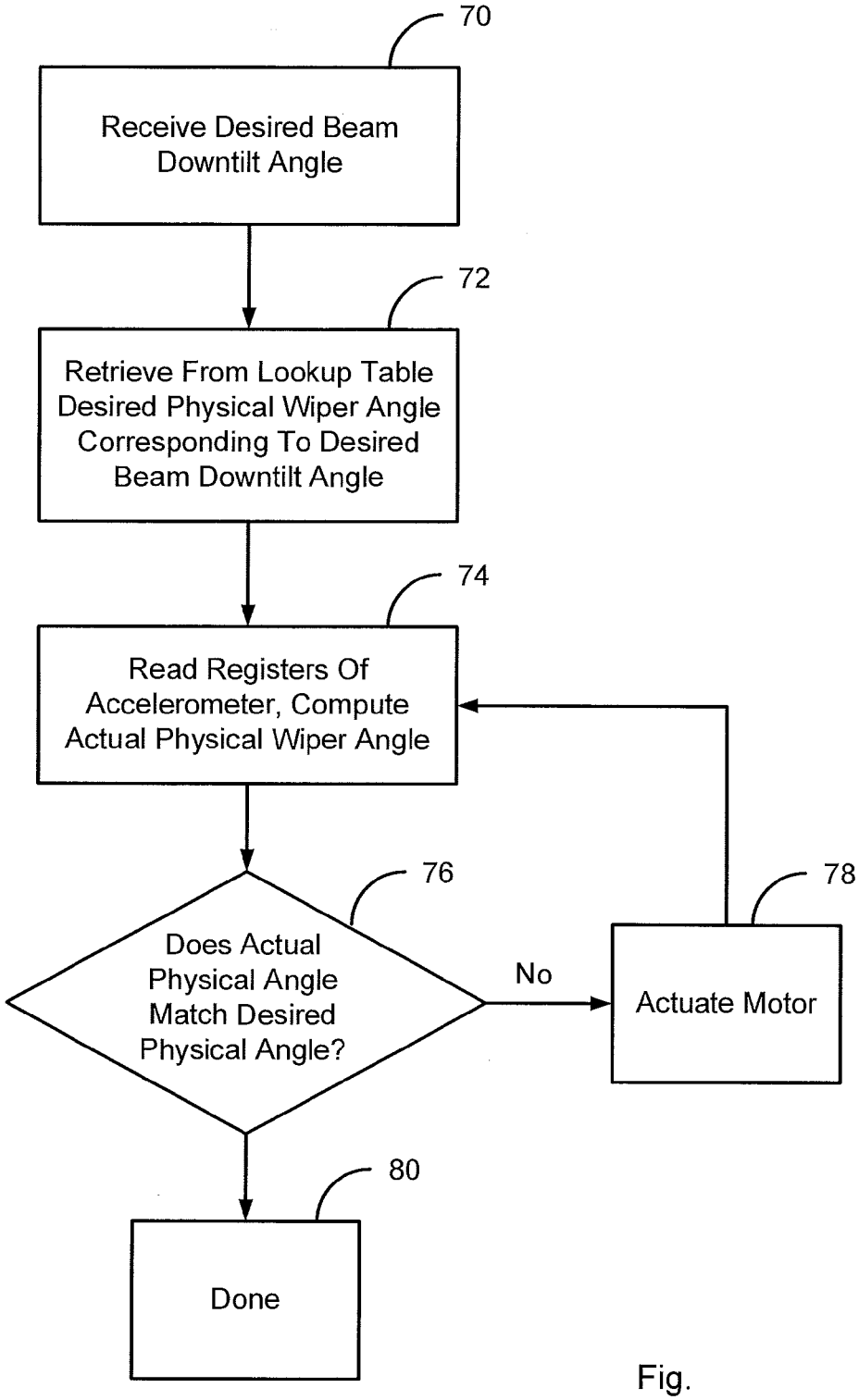
FIG. 4 is a flow diagram of a method for setting the angle of a wiper PCB of a phase shifter according to a desired beam downtilt angle according to one example of the present invention.

As seen in FIG. 4, once the physical angles are determined, a beam downtilt angle may be determined as in 70. The actual physical angle of the wiper PCB 24 may be correlated to, but is not the same as, the downtilt angle of the radiated beam of the panel antenna. A correlation of a physical angle of a wiper arm to a downtilt angle of a radiated antenna beam may be determined empirically and stored in a look-up table in non-volatile memory 58 (FIG. 3). When microcontroller 52 receives an instruction to set the antenna to a specified beam downtilt angle, the microcontroller would access a look up table to retrieve the corresponding wiper PCB 24 physical angle as in 72.

When the microcontroller 52 receives an instruction to adjust downtilt, the microcontroller 52 may actuate the motor while monitoring phase shifter wiper PCB 24 position. During movement of the wiper PCB 24, the registers of the accelerometer 50 may be read a number of times as in 74 to determine a position of the wiper PCB 24. The microcontroller 52 can determine if the actual physical angle matches the desired physical angle as in 76 and if not (i.e., "No"), actuate the motor as in 78. The microcontroller 52 may be configured to stop movement of the actuator 60 when the wiper PCB 24 reaches a desired physical angle as in 80 (i.e., "Done"). The registers may also be read while the phase shifters are stationary to confirm phase angle, to determine default mechanical angle, or act as a level and installation of the panel antenna.

From the foregoing, it will be observed that numerous variations and modifications may be effected without departing from the spirit and scope of the invention. It is to be understood that no limitation with respect to the specific system or method illustrated herein is intended or should be intended. It is, of course, intended to cover by the appended claims all such modifications as fall within the spirit and scope of the claims.

What is claimed is:

1. A variable element, comprising:

a. a stationary circuit board, having at least one transmission line having a first output and a second output;

b. a rotatable circuit board, the rotatable circuit board including:

i. an input and a coupling section, the coupling section located to capacitively couple an input signal to the at least one transmission line between the first output and the second output; and ii. an accelerometer disposed on the rotatable circuit board and oriented such that the accelerometer provides a first signal indicative of a first physical angle of a first axis of the rotatable circuit board with respect to a first reference axis;

c. a look-up table having a plurality of desired physical angles of the rotatable circuit board correlated to a plurality of beam attributes; and d. a controller configured to access the lookup table to obtain a desired physical angle of the rotatable circuit board that corresponds to a desired beam attribute, and to access the accelerometer to obtain the first signal indicative of the first physical angle of the first axis of the rotatable circuit board.

2. The variable element of claim 1, wherein the stationary circuit board and the rotatable circuit board comprise a phase shifter and the desired beam attribute comprises a desired beam downtilt angle.

3. The variable element of claim 2, wherein the controller is further configured to operate an actuator to cause the rotatable circuit board to move to the desired physical angle corresponding to the desired beam downtilt angle.

4. The variable element of claim 1, further comprising an actuator, wherein the actuator includes the controller, a non-volatile memory coupled to the controller and including the look-up table, and a motor coupled to the controller, and the controller is further configured to operate the motor to cause the rotatable circuit board to move to the desired physical angle corresponding to the desired beam attribute.

5. The variable element of claim 1, wherein the accelerometer further provides a second signal indicative of a second physical angle of a second axis of the rotatable circuit board with respect to a second reference axis.

6. The variable element of claim 5, wherein the look-up table further comprises a plurality of default tilt angles and beam downtilt angles correlated to the first and second physical angles.

7. A variable element, comprising:

a. a stationary circuit board, having at least one transmission line having a first output and a second output;

b. a rotatable circuit board, the rotatable circuit board including:

i. an input and a coupling section, the coupling section located to capacitively couple an input signal to the at least one transmission line between the first output and the second output; and ii. an accelerometer disposed on the rotatable circuit board and oriented such that the accelerometer provides a first signal indicative of a first physical angle of a first axis of the rotatable circuit board with respect to a first reference axis;

c. a look-up table having a plurality of desired accelerometer values of the rotatable circuit board correlated to a plurality of beam attributes; and d. a controller configured to access the lookup table to obtain a desired accelerometer value of the rotatable circuit board that corresponds to a desired beam attribute, and to access the accelerometer to obtain the first signal indicative of the first physical angle of the first axis of the rotatable circuit board.

8. The variable element of claim 7, wherein the accelerometer further provides a second signal indicative of a second accelerometer value of a second axis of the rotatable circuit board with respect to a second reference axis.

9. A phase shifter, comprising:

a. a stationary circuit board, having at least one transmission line having a first output and a second output;

b. a rotatable circuit board, the rotatable circuit board including:

i. an input and a coupling section, the coupling section located to capacitively couple an input signal to the at least one transmission line between the first output and the second output; and ii. an accelerometer, disposed on the rotatable circuit board, and oriented such that the accelerometer provides a first signal indicative of a first physical angle of a first axis of the rotatable circuit board with respect to a first reference axis;

c. a look-up table having a plurality of physical angles of the rotatable circuit board correlated to a plurality of beam downtilt angles; and d. a controller configured to access the lookup table to obtain a desired physical angle of the rotatable circuit board that corresponds to a desired beam downtilt angle, and to access the accelerometer to obtain the first signal indicative of the first physical angle of the first axis of the rotatable circuit board.

10. The variable element of claim 9, wherein the accelerometer further provides a second signal indicative of a second physical angle of a second axis of the rotatable circuit board with respect to a second reference axis, and wherein the look-up table further comprises a plurality of default tilt angles and beam downtilt angles correlated to the first and second physical angles.

11. The variable element of claim 9, further comprising an actuator, wherein the actuator includes the controller, a non-volatile memory coupled to the controller and including the look-up table, and a motor coupled to the controller, and the controller is further configured to operate the motor to cause the rotatable circuit board to move to the desired physical angle corresponding to the desired beam downtilt angle.

* * * * *